US009249699B2

(12) United States Patent
Gieselman

(10) Patent No.: US 9,249,699 B2
(45) Date of Patent: Feb. 2, 2016

(54) LUBRICATING COMPOSITION CONTAINING A DISPERSANT

(75) Inventor: Matthew D. Gieselman, Wickliffe, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/126,509

(22) PCT Filed: Jun. 18, 2012

(86) PCT No.: PCT/US2012/042921

§ 371 (c)(1), (2), (4) Date: Dec. 16, 2013

(87) PCT Pub. No.: WO2012/177549

PCT Pub. Date: Dec. 27, 2012

(65) Prior Publication Data

US 2014/0116368 A1 May 1, 2014

Related U.S. Application Data

(60) Provisional application No. 61/499,375, filed on Jun. 21, 2011.

(51) Int. Cl.

| | |
|---|---|
| ***C10M 169/04*** | (2006.01) |
| ***C10M 105/36*** | (2006.01) |
| ***F01M 1/00*** | (2006.01) |
| ***C10M 145/22*** | (2006.01) |
| ***C10M 161/00*** | (2006.01) |

(52) U.S. Cl.

CPC ..... *F01M 1/00* (2013.01); *C10M 145/22* (2013.01); *C10M 161/00* (2013.01); *C10M 169/04* (2013.01); *C10M 2209/102* (2013.01); *C10M 2215/28* (2013.01); *C10N 2230/04* (2013.01); *C10N 2240/10* (2013.01); *C10N 2240/102* (2013.01); *C10N 2240/104* (2013.01)

(58) Field of Classification Search

CPC ..... C10M 145/22; C10M 2209/102
USPC ..... 508/304, 496
See application file for complete search history.

(56) References Cited

U.S. PATENT DOCUMENTS

| | | | | |
|---|---|---|---|---|
| 2,877,181 | A | 3/1959 | Dilworth et al. | |
| 3,429,820 | A | 2/1969 | Lyons | |
| 3,909,425 | A | 9/1975 | Crawford et al. | |
| 6,194,359 | B1 * | 2/2001 | Beyer et al. | 508/279 |
| 7,615,521 | B2 * | 11/2009 | Eveland et al. | 508/228 |
| 2010/0024286 | A1 | 2/2010 | Smith et al. | |
| 2010/0024287 | A1 | 2/2010 | Smith et al. | |

FOREIGN PATENT DOCUMENTS

| | | | |
|---|---|---|---|
| EP | 0194718 | A2 | 5/2006 |
| WO | 2006054044 | A1 | 5/2006 |
| WO | 2007128740 | A1 | 11/2007 |
| WO | 2009053413 | A1 | 4/2009 |
| WO | 2009156393 | A1 | 12/2009 |
| WO | 2010012756 | A1 | 2/2010 |
| WO | 2010012763 | A1 | 2/2010 |
| WO | 2010014678 | A1 | 2/2010 |
| WO | 2010015706 | A1 | 2/2010 |

* cited by examiner

*Primary Examiner* — Prem C Singh
*Assistant Examiner* — Francis C Campanell
(74) *Attorney, Agent, or Firm* — David M. Shold; Teresan W. Gilbert

(57) ABSTRACT

The invention provides a lubricating composition containing a lubricating composition comprising an oil of lubricating viscosity and a polyester. The invention further relates to a method of lubricating a mechanical device (such as an internal combustion engine) with the lubricating composition. The invention further relates to the use of the polyester as a dispersant.

10 Claims, No Drawings

LUBRICATING COMPOSITION CONTAINING A DISPERSANT

FIELD OF INVENTION

The invention provides a lubricating composition containing a lubricating composition comprising an oil of lubricating viscosity and a polyester. The invention further relates to a method of lubricating a mechanical device (such as an internal combustion engine) with the lubricating composition. The invention further relates to the use of the polyester as a dispersant.

BACKGROUND OF THE INVENTION

In order to reduce deposit formation, detergents and dispersants are known to assist in maintaining reduced amounts of deposits on engine components. The lubricant industry has a number of tests used to evaluate a lubricant's ability to handle deposits and sludge including the Sequence VG, Sequence IIIG, TDi, Cat 1N, and OM501LA.

With recent changes to engine specifications there is an increasing demand on the lubricant to reduce deposits. For instance, the new ILSAC GF-5 specification requires a 4.0 weighted piston deposit rating in the Sequence IIIG (vs. 3.5 for GF-4).

International Application WO2007/128740 (published 15 November, 2007) discloses the use of one or more poly (hydroxycarboxylic acid) amide salt in combination with one or more antiwear additive. Such compositions were useful for dispersing preformed sludge deposits.

International Application WO2009/053413 (published 30 Apr. 2009) and European Patent Application EP2055729 (published 6 May 2009) both disclose compositions comprising base oil and one or more poly (hydroxycarboxylic acid) amide salt derivatives. The lubricating oils were useful for reducing wear and friction.

International Application WO2009/156393 (published 30 Dec. 2009) discloses a lubricant with one or more poly (hydroxycarboxylic acid) amide salt with TBN less than 10. The Lubricant ameliorated piston deposits in fired engine tests such as the TU5 and Sequence IIIF.

International Application WO2010/012756 (published 4 Feb. 2010) and US Patent Application US2010/0024286 (published 4 Feb. 2010) both disclose a fuel composition comprising a fuel and one or more poly (hydroxycarboxylic acid) amide salts. Such fuels offered benefits such as improved lubricity by HFRR, Improved inlet valve deposits in fired engine tests and improved sludge dispersancy in the Sequence VG engine test.

International Application WO2010/014678 (published 4 Feb. 2010) discloses a poly (hydroxycarboxylic acid) amide salt derivative wherein the anionic portion of the salt does not contain sulphur. The molecules described showed lower phosphorus volatility in Selby NOACK testing in fully formulated fluids than similar materials that had sulphur-containing anions.

International Application WO2010/015706 (published 11 Feb. 2010) discloses a lubricant comprising base oil, a poly (hydroxycarboxylic acid) amide salt and one or more detergents. The composition is useful for dispersing preformed sludge deposits.

International Application WO2010/012763 (published 4 Feb. 2010) and US Patent Application US2010/0024287 (published 4 Feb. 2010) both disclose a fuel composition comprising a fuel and one or more poly (hydroxycarboxylic acid) derivative having a terminal acid group. The fuels of the disclosed composition demonstrated some improved lubricity characteristics.

SUMMARY OF THE INVENTION

The objectives of the present invention include providing at least one of (i) dispersancy, (ii) cleanliness, or (iii) a lubricant with reduced sludge deposit formation.

As used herein reference to the amounts of additives present in the lubricating composition disclosed are quoted on an oil free basis, i.e., amount of actives, unless otherwise indicated.

In one embodiment the present invention provides a lubricating composition comprising an oil of lubricating viscosity and 0.05 wt % to 10 wt % of a polyester which comprises a self-condensation product of a $C_{8-22}$ (or $C_{10-20}$) fatty carboxylic acid containing at least one hydroxyl group.

The self-condensation product of the $C_{8-22}$ (or $C_{10-20}$) fatty carboxylic acid containing at least one hydroxyl group may produce a polyester comprising 2 to 10, or 2 to 8, or 3 to 6 repeat units of said acid.

In one embodiment the present invention provides a lubricating composition comprising a dispersant (typically a succinimide dispersant), an oil of lubricating viscosity and a 0.05 wt % to 10 wt % of a polyester which comprises a self-condensation product of a $C_{8-22}$ (or $C_{10-20}$) fatty carboxylic acid containing at least one hydroxyl group.

In one embodiment the present invention provides a lubricating composition comprising:

an oil of lubricating viscosity;

0.1 wt % to 10 wt %, or 1 wt % to 8 wt % of a polyester which comprises a self-condensation product of a $C_{8-22}$ (or $C_{10-20}$) fatty carboxylic acid containing at least one hydroxyl group; and 0.1 wt % to 15 wt %, or 0.5 wt % to 9 wt % of a dispersant (typically a succinimide dispersant).

In one embodiment the present invention provides a lubricating composition comprising:

an oil of lubricating viscosity;

1 wt % to 6.5 wt % of a polyester which comprises a self-condensation product of a $C_{8-22}$ (or $C_{10-20}$) fatty carboxylic acid containing at least one hydroxyl group; and 2 wt % to 8.5 wt % of a dispersant (typically a succinimide dispersant).

In one embodiment the invention provides for a method of lubricating a mechanical device with a lubricating composition disclosed herein. The mechanical device may be an internal combustion engine.

The internal combustion engine may have a steel surface on at least one of a cylinder bore, cylinder block, or piston ring.

The internal combustion engine may have an aluminium alloy, or aluminium composite surface on at least one of a cylinder bore, cylinder block, or piston ring.

In one embodiment the invention provides for the use of the polyester of the invention as a dispersant in a lubricant for use in an internal combustion engine.

DETAILED DESCRIPTION OF THE INVENTION

The present invention provides a detergent, a process to prepare a detergent/dispersant, a lubricating composition, a method for lubricating a mechanical device and a use as disclosed above.

The Polyester

As used herein the term "fatty carboxylic acid" used in relation to the polyester means an acid with a carbon chain of 8 to 22, or 10 to 22 carbon atoms.

As used herein the term "polyester" is intended to include a polymer in which the monomer units are linked together by a group —C(O)O—.

The $C_{8-22}$ (or $C_{10-20}$) fatty carboxylic acid containing at least one hydroxyl group from which the polyester of the present invention may be prepared include a compound represented by the formula:

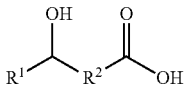

(I)

wherein $R^1$ may be a hydrogen or a hydrocarbyl group containing from 1 to 20 carbon atoms and $R^2$ may be a hydrocarbylene group containing from 1 to 20 carbon atoms, with the proviso that the total number of carbon atoms present from $R^1$ and $R^2$ may be 6 or more, or 8 or more. In some embodiments $R^1$ contains from 1 to 12, 2 to 10, 4 to 8 or even 6 carbon atoms $R^2$ may contain from 2 to 16, 6 to 14, 8 to 12, or even 10 carbon atoms.

In some embodiments the fatty carboxylic acid used in the preparation of the polyester may be 12-hydroxystearic acid, ricinoleic acid, 12-hydroxy dodecanoic acid, 5-hydroxy dodecanoic acid, 5-hydroxy decanoic acid, 4-hydroxy decanoic acid, 10-hydroxy undecanoic acid, or combinations thereof.

In one embodiment the fatty carboxylic acid used in the preparation of the polyester may be 12-hydroxystearic acid. In one embodiment the fatty carboxylic acid used in the preparation of the polyester may be ricinoleic acid.

In these embodiments the polyester may (or may not) be capped with a C1-22, or a C8-20, fatty acid. Examples of suitable acids include oleic acid, palmitic acid, stearic acid, erucic acid, lauric acid, 2-ethylhexanoic acid, 9,11-linoleic acid, 9,12-linoleic acid, 9,12,15-linolenic acid, abietic acid, or combinations thereof.

The number average molecular weight (Mn) of the polyesters of the invention may be from 500 to 3000, or from 700 to 2500.

The polyester useful in the present invention may be obtained/obtainable by heating one or more hydroxycarboxylic acids or a mixture of the hydroxycarboxylic acid and a carboxylic acid, optionally in the presence of an esterification catalyst. The hydroxycarboxylic acids may, in certain embodiments, have the formula HO—X—COOH wherein X may be a divalent saturated or unsaturated aliphatic radical containing at least 8 carbon atoms and in which there are at least 4 carbon atoms between the hydroxy and carboxylic acid groups, or from a mixture of such a hydroxycarboxylic acid and a carboxylic acid which is free from hydroxy groups. This reaction may be carried out at a temperature in the region of 160° C. to 200° C., until the desired molecular weight has been obtained. The course of the esterification may be followed by measuring the acid value of the product, with the desired polyester, in some embodiments, having an acid value in the range of 10 to 100 mg KOH/g or in the range of 20 to 50 mg KOH/g. The indicated acid value range of 10 to 100 mg KOH/g is equivalent to a number average molecular weight range of 5600 to 560. The water formed in the esterification reaction may be removed from the reaction medium, and this may be conveniently done by passing a stream of nitrogen over the reaction mixture or by carrying out the reaction in the presence of a solvent, such as toluene or xylene, and distilling off the water as it is formed.

The resulting polyester may then be isolated in conventional manner; however, when the reaction is carried out in the presence of an organic solvent whose presence would not be harmful in the subsequent application, the resulting solution of the polyester may be used.

In the said hydroxycarboxylic acids the radical represented by X may contain from 12 to 20 carbon atoms, optionally where there are between 8 and 14 carbon atoms between the carboxylic acid and hydroxy groups. In some embodiments the hydroxycarboxylic acid may contain a second hydroxy group. Typically, the hydroxycarboxylic acid may contain one hydroxy group and one carboxylic acid group.

Specific examples of such hydroxycarboxylic acids include ricinoleic acid, a mixture of 9- and 10-hydroxystearic acids (obtained by sulphation of oleic acid followed by hydrolysis), and 12-hydroxystearic acid, and especially the commercially available hydrogenated castor oil fatty acid which contains in addition to 12-hydroxystearic acid minor amounts of stearic acid and palmitic acid.

The carboxylic acids which may be used in conjunction with the hydroxycarboxylic acids to obtain these polyesters are preferably carboxylic acids of saturated or unsaturated aliphatic compounds, particularly alkyl and alkenyl carboxylic acids containing a chain of from 8 to 20 carbon atoms. As examples of such acids there may be mentioned lauric acid, palmitic acid, stearic acid and oleic acid.

In one embodiment the polyester may be derived from commercial 12-hydroxy-stearic acid and may have a number average molecular weight of about 1600. Polyesters such as this are described in greater detail in U.K. Patent Specification Nos. 1373660 and 1342746.

In certain embodiments the polyester may be present at 0.1 wt % to 10 wt %, or 1 wt % to 8 wt %, or 2 wt % to 6.5 wt % of the lubricating composition.

Dispersant

The lubricating composition may further include a dispersant, or mixtures thereof. The dispersant may be a succinimide dispersant, a Mannich dispersant, a succinamide dispersant, a polyolefin succinic acid ester, amide, or ester-amide, or mixtures thereof. In one embodiment the invention does include a dispersant or mixtures thereof. The dispersant may be present as a single dispersant. The dispersant may be present as a mixture of two or more (typically two or three) different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetra-ethylenepentamine, pentaethylenehexamine, polyamine still bottoms, and mixtures thereof.

In one embodiment the dispersant may be a polyolefin succinic acid ester, amide, or ester-amide. For instance, a polyolefin succinic acid ester may be a polyisobutylene succinic acid ester of pentaerythritol, or mixtures thereof. A polyolefin succinic acid ester-amide may be a polyisobutylene succinic acid reacted with an alcohol (such as pentaerythritol) and an amine (such as a diamine, typically diethyleneamine).

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersants may also be post-treated by conventional methods by a reaction with any of a variety of agents. Among these are boron compounds (such as boric acid), urea, thiourea, dimercaptothiadiazoles, carbon disulphide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in US Patent Application US2009/0054278.

In one embodiment the dispersant may be borated or non-borated. Typically a borated dispersant may be a succinimide dispersant.

The dispersant may be prepared/obtained/obtainable from reaction of succinic anhydride by an "ene" or "thermal" reaction, by what is referred to as a "direct alkylation process." The "ene" reaction mechanism and general reaction conditions are summarised in "Maleic Anhydride", pages, 147-149, Edited by B. C. Trivedi and B. C. Culbertson and Published by Plenum Press in 1982. The dispersant prepared by a process that includes an "ene" reaction may be a polyisobutylene succinimide having a carbocyclic ring present on less than 50 mole %, or 0 to less than 30 mole %, or 0 to less than 20 mole %, or 0 mole % of the dispersant molecules. The "ene" reaction may have a reaction temperature of 180° C. to less than 300° C., or 200° C. to 250° C., or 200° C. to 220° C.

The dispersant may also be obtained/obtainable from a chlorine-assisted process, often involving Diels-Alder chemistry, leading to formation of carbocyclic linkages. The process is known to a person skilled in the art. The chlorine-assisted process may produce a dispersant that is a polyisobutylene succinimide having a carbocyclic ring present on 50 mole % or more, or 60 to 100 mole % of the dispersant molecules. Both the thermal and chlorine-assisted processes are described in greater detail in U.S. Pat. No. 7,615,521, columns 4-5 and preparative examples A and B.

The dispersant may have a carbonyl to nitrogen ratio (CO:N ratio) of 5:1 to 1:10, 2:1 to 1:10, or 2:1 to 1:5, or 2:1 to 1:2. In one embodiment the dispersant may have a CO:N ratio of 2:1 to 1:10, or 2:1 to 1:5, or 2:1 to 1:2, or 1:1.4 to 1:0.6.

The dispersant may be present at 0 wt % to 20 wt %, 0.1 wt % to 15 wt %, or 0.5 wt % to 9 wt %, or 1 wt % to 8.5 wt % of the lubricating composition.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] (a similar disclosure is provided in US Patent Application 2010/197536, see to [0073]). A more detailed description of natural and synthetic lubricating oils is described in paragraphs [0058] to [0059] respectively of WO2008/147704 (a similar disclosure is provided in US Patent Application 2010/197536, see [0075] to [0076]). Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarised in U.S. Pat. No. 7,285,516 (see column 11, line 64 to column 12, line 10). In one embodiment the oil of lubricating viscosity may be an API Group II, Group III, Group IV oil, or mixtures thereof.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

Other Performance Additives

A lubricating composition may be prepared by adding the product of the process described herein to an oil of lubricating viscosity, optionally in the presence of other performance additives (as described herein below).

The lubricating composition of the invention optionally comprises other performance additives. The other performance additives include at least one of metal deactivators, viscosity modifiers, detergents, friction modifiers, antiwear agents, corrosion inhibitors, dispersant viscosity modifiers, extreme pressure agents, antioxidants, foam inhibitors, demulsifiers, pour point depressants, seal swelling agents and mixtures thereof. Typically, fully-formulated lubricating oil will contain one or more of these performance additives.

The lubricating composition of the invention may further include other additives. In one embodiment the invention provides a lubricating composition further comprising at least one of a dispersant, an antiwear agent, a dispersant viscosity modifier, a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

In one embodiment the lubricating composition may be a lubricating composition further comprising a molybdenum compound. The molybdenum compound may be an antiwear agent or an antioxidant. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

Antioxidants include sulphurised olefins, diarylamines, alkylated diarylamines, hindered phenols, molybdenum compounds (such as molybdenum dithiocarbamates), hydroxylthioethers, or mixtures thereof. In one embodiment the lubricating composition includes an antioxidant, or mixtures thereof. The antioxidant may be present at 0 wt % to 15 wt %, or 0.1 wt % to 10 wt %, or 0.5 wt % to 5 wt %, or 0.5 wt % to 3 wt %, or 0.3 wt % to 1.5 wt % of the lubricating composition.

The diarylamine or alkylated diarylamine may be a phenyl-α-naphthylamine (PANA), an alkylated diphenylamine, or an alkylated phenylnapthylamine, or mixtures thereof. The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the alkylated diphenylamine may include nonyl diphenylamine, or dinonyl diphenylamine. The alkylated diarylamine may include octyl, di-octyl, nonyl, di-nonyl, decyl or di-decyl phenylnapthylamines.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butyl-phenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

Examples of molybdenum dithiocarbamates, which may be used as an antioxidant, include commercial materials sold under the trade names such as Vanlube 822™ and Molyvan™ A from R. T. Vanderbilt Co., Ltd., and Adeka Sakura-Lube™ S-100, S-165, S-600 and 525, or mixtures thereof.

In one embodiment the lubricating composition further includes a viscosity modifier. The viscosity modifier is known in the art and may include hydrogenated styrene-butadiene rubbers, ethylene-propylene copolymers, polymethacrylates, polyacrylates, hydrogenated styrene-isoprene polymers, hydrogenated diene polymers, polyalkyl styrenes, polyolefins, esters of maleic anhydride-olefin copolymers (such as those described in International Application WO 2010/014655), esters of maleic anhydride-styrene copolymers, or mixtures thereof.

The dispersant viscosity modifier may include functionalised polyolefins, for example, ethylene-propylene copolymers that have been functionalised with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; 6,117,825; and U.S. Pat. No. 7,790,661. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]). In one embodiment the dispersant viscosity modifier may include those described in U.S. Pat. No. 7,790,661 column 2, line 48 to column 10, line 38.

In one embodiment the lubricating composition of the invention further comprises a dispersant viscosity modifier. The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

In one embodiment the invention provides a lubricating composition further comprising an overbased metal-containing detergent. The metal of the metal-containing detergent may be zinc, sodium, calcium, barium, or magnesium. Typically the metal of the metal-containing detergent may be sodium, calcium, or magnesium.

The overbased metal-containing detergent may be selected from the group consisting of non-sulphur containing phenates, sulphur containing phenates, sulphonates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased detergent may be sodium, calcium or magnesium salt of the phenates, sulphur containing phenates, sulphonates, salixarates and salicylates. Overbased phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a linear alkylbenzene sulphonate detergent having a metal ratio of at least 8 as is described in paragraphs [0026] to [0037] of US Patent Application 2005065045 (and granted as U.S. Pat. No. 7,407,919). Linear alkyl benzenes may have the benzene ring attached anywhere on the linear chain, usually at the 2, 3, or 4 position, or mixtures thereof. The linear alkylbenzene sulphonate detergent may be particularly useful for assisting in improving fuel economy. In one embodiment the sulphonate detergent may be a metal salt of one or more oil-soluble alkyl toluene sulphonate compounds as disclosed in paragraphs [0046] to [0053] of US Patent Application 2008/0119378.

Typically the overbased metal-containing detergent may be a calcium or magnesium an overbased detergent.

Overbased detergents are known in the art. Overbased materials, otherwise referred to as overbased or superbased salts, are generally single phase, homogeneous Newtonian systems characterised by a metal content in of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a calcium chloride, acetic acid, phenol or alcohol. The acidic organic material will normally have a sufficient number of carbon atoms to provide a degree of solubility in oil. The amount of "excess" metal (stoichiometrically) is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio is also explained in standard textbook entitled "Chemistry and Technology of Lubricants", Third Edition, Edited by R. M. Mortier and S. T. Orszulik, Copyright 2010, page 219, sub-heading 7.25.

The overbased detergent (other than the detergent of the present invention) may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition. In one embodiment, an engine lubricating composition further comprises at least one overbased detergent with a metal ratio of at least 3, or at least 8, or at least 15.

In one embodiment the friction modifier may be selected from the group consisting of long chain fatty acid derivatives of amines, long chain fatty esters, or derivatives of long chain fatty epoxides; fatty imidazolines; amine salts of alkylphosphoric acids; fatty alkyl tartrates; fatty alkyl tartrimides; fatty alkyl tartramides; fatty glycolates; and fatty glycolamides. The friction modifier may be present at 0 wt % to 6 wt %, or 0.01 wt % to 4 wt %, or 0.05 wt % to 2 wt %, or 0.1 wt % to 2 wt % of the lubricating composition.

As used herein the term "fatty alkyl" or "fatty" in relation to friction modifiers means a carbon chain having 10 to 22 carbon atoms, typically a straight carbon chain.

Examples of suitable friction modifiers include long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulphurised fatty compounds and olefins, molybdenum dialkyldithiophosphates, molybdenum dithiocarbamates, sunflower oil or soybean oil monoester of a polyol and an aliphatic carboxylic acid.

In one embodiment the friction modifier may be a long chain fatty acid ester. In another embodiment the long chain fatty acid ester may be a mono-ester and in another embodiment the long chain fatty acid ester may be a triglyceride.

The lubricating composition optionally further includes at least one antiwear agent. Examples of suitable antiwear agents include titanium compounds, tartrates, tartrimides, oil soluble amine salts of phosphorus compounds, sulphurised olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thio-carbamates, and bis(S-alkyldithiocarbamyl) disulphides.

The antiwear agent may in one embodiment include a tartrate or tartrimide as disclosed in International Publication WO 2006/044411 or Canadian Patent CA 1 183 125. The tartrate or tartrimide may contain alkyl-ester groups, where the sum of carbon atoms on the alkyl groups is at least 8. The antiwear agent may in one embodiment include a citrate as is disclosed in US Patent Application 20050198894.

The lubricating composition may further include a phosphorus-containing antiwear agent. Typically the phosphorus-containing antiwear agent may be a zinc dialkyldithiophosphate, phosphite, phosphate, phosphonate, and ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

Another class of additives includes oil-soluble titanium compounds as disclosed in U.S. Pat. No. 7,727,943 and US2006/0014651. The oil-soluble titanium compounds may function as antiwear agents, friction modifiers, antioxidants, deposit control additives, or more than one of these functions. In one embodiment the oil soluble titanium compound is a titanium (IV) alkoxide. The titanium alkoxide is formed from a monohydric alcohol, a polyol or mixtures thereof. The monohydric alkoxides may have 2 to 16, or 3 to 10 carbon atoms. In one embodiment, the titanium alkoxide is titanium (IV) isopropoxide. In one embodiment, the titanium alkoxide is titanium (IV) 2-ethylhexoxide. In one embodiment, the titanium compound comprises the alkoxide of a vicinal 1,2-diol or polyol. In one embodiment, the 1,2-vicinal diol comprises a fatty acid mono-ester of glycerol, often the fatty acid is oleic acid.

In one embodiment, the oil soluble titanium compound is a titanium carboxylate. In one embodiment the titanium (IV) carboxylate is titanium neodecanoate.

Useful corrosion inhibitors for an engine lubricating composition include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Foam inhibitors that may be useful in the compositions of the invention include polysiloxanes, copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

Demulsifiers include trialkyl phosphates, and various polymers and copolymers of ethylene glycol, ethylene oxide, propylene oxide, or mixtures thereof.

Metal deactivators include derivatives of benzotriazoles (typically tolyltriazole), 1,2,4-triazoles, benzimidazoles, 2-alkyldithiobenzimidazoles or 2-alkyldithiobenzothiazoles. The metal deactivators may also be described as corrosion inhibitors.

Seal swell agents include sulpholene derivatives Exxon Necton37™ (FN 1380) and Exxon Mineral Seal Oil™ (FN 3200).

An engine lubricating composition in different embodiments may have a composition as disclosed in the following table

| | Embodiments (wt %) | | |
|---|---|---|---|
| Additive | A | B | C |
| Polyester | 0.01 to 8 | 0.1 to 6 | 0.15 to 5 |
| Dispersant | 0 to 12 | 0 to 8 | 0.5 to 6 |
| Dispersant Viscosity Modifier | 0 to 5 | 0 to 4 | 0.05 to 2 |
| Overbased Detergent | 0.1 to 15 | 0.1 to 10 | 0.2 to 8 |
| Antioxidant | 0.1 to 13 | 0.1 to 10 | 0.5 to 5 |
| Antiwear Agent | 0.1 to 15 | 0.1 to 10 | 0.3 to 5 |
| Friction Modifier | 0.01 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

INDUSTRIAL APPLICATION

In one embodiment the invention provides a method of lubricating an internal combustion engine. The engine components may have a surface of steel or aluminium.

An aluminium surface may be derived from an aluminium alloy that may be a eutectic or a hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an exhaust gas recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine, a mixed gasoline/alcohol fuelled engine, or a hydrogen fuelled internal combustion engine. In one embodiment the internal combustion engine may be a diesel fuelled engine and in another embodiment a gasoline fuelled engine. In one embodiment the internal combustion engine may be a heavy duty diesel engine.

The internal combustion engine may be a 2-stroke or 4-stroke engine. Suitable internal combustion engines include marine diesel engines, aviation piston engines, low-load diesel engines, and automobile and truck engines. The marine diesel engine may be lubricated with a marine diesel cylinder lubricant (typically in a 2-stroke engine), a system oil (typically in a 2-stroke engine), or a crankcase lubricant (typically in a 4-stroke engine).

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.04 wt % to 0.12 wt %. In one embodiment the phosphorus content may be 100 ppm to 1000 ppm, or 200 ppm to 600 ppm. The total sulphated ash content may be 0.3 wt % to 1.2 wt %, or 0.5 wt % to 1.1 wt % of the lubricating composition. In one embodiment the sulphated ash content may be 0.5 wt % to 1.1 wt % of the lubricating composition.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

The following examples provide illustrations of the invention. These examples are non-exhaustive and are not intended to limit the scope of the invention.

EXAMPLES

Example 1

Example 1 is a polyester of the current invention. The polyester acid is prepared by reacting 12-hydroxystearic acid in a vessel fitted with a stirrer, Dean-Stark trap, sub-surface nitrogen inlet line and thermocouple. The reaction is heated to about 100° C. and zirconium butoxide (0.57 wt %) is added and the mixture is heated to about 195° C. for 12 hours. Water is collected in the Dean-Stark trap until the total acid number is about 30-35 mg KOH/g. The resulting product is cooled and collected.

A series of engine lubricants are prepared containing the products of the examples above.

The engine lubricants include both heavy diesel (HD) and gasoline passenger car (PC) lubricants. In the lubricant examples below all amounts are expressed on an actives basis.

Comparative Lubricant Example 1 (CLE1) is a passenger car lubricant. CLE1 is an API SM capable 5W-30 lubricant containing 2 wt % of a succinimide dispersant. The lubricant contains 1.25 wt % of an antioxidant system (containing a mixture of aminic, phenolic and sulphur-containing antioxidants), 0.79 wt % of a zinc dialkyldithiophosphate, 0.62 wt % of an ethylene-propylene copolymer viscosity modifier, 0.14 wt % of a pour point depressant, 0.91 wt % of a detergent system (containing a mixture of a sodium overbased sulphonate and calcium overbased sulphonate), 11 ppm of siloxane antifoam agent, and balance API Group II base oil.

Engine Lubricant 1 (EL1): is the same as CLE1 except it further contains 3 wt % of Example 1.

The PC compositions (CLE1 and EL1) are tested in a panel coker apparatus. 210 g of oil to be analysed is placed in a steel sump chamber at 105° C. An agitator consisting of several metal tongs on a spindle is inserted into the sump and spun at 1000 rpm. The apparatus is capped with a flat aluminum plate with a constant surface temperature of 325° C. The agitator sprays a continuous thin layer of oil onto the aluminum plate for a period of 4 hours. At the end of test, the plate is removed and optically rated. A rating scale is applied with 0 meaning a plate completely covered in black deposits and 100 meaning a plate completely free of deposits. The results obtained for the test are presented below:

| | CLE1 | EL1 |
|---|---|---|
| Rating | 55 | 82 |

The data indicates that adding a polyester of the present invention increases the panel coker rating. This means that the addition of polyester improves deposit cleanliness.

Comparative Lubricant Example 2 (CLE2) is a heavy duty diesel lubricant. CLE2 is an API CJ-4 capable 15W-40 Lubricant containing 4.1 wt % of a succinimide dispersant. The lubricant contains 1.23 wt % of an antioxidant system (containing a mixture of aminic, phenolic and sulphur-containing antioxidants), 0.99 wt % of a zinc dialkyldithiophosphate, 1.24 wt % of an ethylene-propylene copolymer viscosity modifier, 0.08 wt % of pour point depressant, 1.71 wt % of a detergent system (containing a mixture of a calcium overbased sulphonate and calcium overbased sulphonate), 100 ppm of siloxane antifoam agent, 0.12 wt % of corrosion inhibitor, and balance API Group II base oil.

Engine Lubricant 2 (EL2): is the same as CLE2 except it further contains 3 wt % of Example 1.

Engine Lubricant 3 (EL3): is the same as CLE2 except it contains only 2.1 wt % of a succinimide dispersant and 2.1 wt % of Example 1.

Engine Lubricant 4 (EL4): is the same as CLE2 except it contains no succinimide dispersant and 4.1 wt % Example 1.

CLE2 and EL2 to EL4 are evaluated by panel coker test as described above. The results obtained for the heavy duty diesel lubricants are as follows:

| | CLE2 | EL2 | EL3 | EL4 |
|---|---|---|---|---|
| Rating | 46 | 60 | 58 | 9 |

The data indicates that adding a polyester of the present invention increases the panel coker rating. This means that the addition of polyester improves deposit cleanliness. The data further indicates that when the inventive polyester is used in combination with a succinimide dispersant as in EL2 and EL3, coker ratings were far superior to when the polyester was used alone as in EL4. Thus, the polyester of the invention works synergistically with succinimide dispersants to improve coker panel deposits.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704, or a similar definition in paragraphs [0137] to [0141] of published application US 2010-0197536.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

an oil of lubricating viscosity, 1 wt % to 6.5 wt. % of a polyester which comprises a self-condensation product of a hydroxystearic acid, 1 wt % to 6 wt % of a succinimide dispersant, and 0.2 wt % to 3 wt % of an overbased calcium sulphonate detergent.

2. The lubricating composition of claim 1, wherein the self-condensation product of the hydroxystearic acid produces a polyester with 2 to 10, repeat units.

3. The lubricating composition of claim 1, wherein the dispersant is a polyisobutylene succinimide, wherein the polyisobutylene from which the polyisobutylene succinimide is derived has a number average molecular weight in the range of 750 to 2200.

4. The lubricating composition of claim 1, wherein the dispersant is a polyisobutylene succinimide derived from an aliphatic polyamine selected from the group consisting of ethylenediamine, diethylenetriamine, triethylene-tetramine, tetraethylenepentamine, pentaethylenehexamine, polyamine still bottoms, and mixtures thereof.

5. The lubricating composition of claim 1, wherein the dispersant is a polyisobutylene succinimide derived from an aliphatic polyamine selected from tetraethylenepentamine, pentaethylenehexamine, polyamine still bottoms, and mixtures thereof.

6. The lubricating composition of claim 1, wherein the dispersant is a polyisobutylene succinimide having a carbocyclic ring present on less than 50 mole % of the dispersant molecules.

7. The lubricating composition of claim 1, wherein the dispersant is a polyisobutylene succinimide having a carbocyclic ring present on 50 mole % or more of the dispersant molecules.

8. A method of lubricating an internal combustion engine comprising supplying to the internal combustion engine a lubricating composition of claim 1.

9. The method of claim 8, wherein the internal combustion engine has a steel surface on a cylinder bore, cylinder block, or piston ring.

10. The method of claim 8, wherein the internal combustion engine has a surface of steel, or an aluminium alloy, or an aluminium composite.

* * * * *